US006554278B1

(12) United States Patent
Haddox

(10) Patent No.: US 6,554,278 B1
(45) Date of Patent: Apr. 29, 2003

(54) BALL AND TARGET GAME

(76) Inventor: Chris Haddox, 1010 W. 8th, Washington, MO (US) 63090

( * ) Notice: Subject to any disclaimer, the term of this patent is extended or adjusted under 35 U.S.C. 154(b) by 0 days.

(21) Appl. No.: 10/140,281

(22) Filed: May 6, 2002

(51) Int. Cl.[7] ..... A63F 7/00; A63F 7/36
(52) U.S. Cl. ..... 273/119 R; 273/123 R
(58) Field of Search ..... 273/118 R, 119 R, 273/123 R, 129 R

(56) References Cited

U.S. PATENT DOCUMENTS

| | | | | | |
|---|---|---|---|---|---|
| 619,663 | A | * | 2/1899 | Bowie | 273/123 R |
| 1,339,343 | A | * | 5/1920 | Hulett | 273/123 R |
| 1,696,408 | A | * | 12/1928 | McMahon | 273/119 R |
| 1,942,280 | A | * | 1/1934 | Fohmann | 273/129 R |
| 2,147,526 | A | * | 2/1939 | Farmer | 273/118 R |
| 3,857,562 | A | * | 12/1974 | Rardon et al. | 473/107 |
| 4,148,487 | A | * | 4/1979 | Bouve | 273/127 B |
| 4,834,384 | A | * | 5/1989 | Cortesi | 273/123 R |
| 5,029,863 | A | * | 7/1991 | Krawczyk et al. | 273/125 R |
| 5,096,192 | A | | 3/1992 | Stanford, Jr. | |
| 5,282,635 | A | | 2/1994 | Hopkins | |
| 5,374,220 | A | | 12/1994 | Burtchett | |
| 5,785,313 | A | * | 7/1998 | Shiraishi | 273/108.1 |
| 5,839,724 | A | * | 11/1998 | Bunac, Jr. | 273/127 R |
| 5,865,681 | A | | 2/1999 | Tudek et al. | |
| 6,039,655 | A | | 3/2000 | Todokoro | |
| 6,089,570 | A | | 7/2000 | Gruber | |
| 6,213,886 | B1 | | 4/2001 | Johnson | |
| 6,349,939 | B1 | | 2/2002 | Tsai | |

* cited by examiner

*Primary Examiner*—Raleigh W. Chiu
(74) *Attorney, Agent, or Firm*—Thompson Coburn LLP

(57) ABSTRACT

The invention is an amusement device involving a ball, a set of targets and a set of obstructions. Specifically, the device has a target is a plurality of concavities towards which a ball is rolled. A plurality of obstructions located near the concavities act to deflect a rolling ball. A peripheral groove surrounds a playing surface to collect errant balls. A projection device is used to roll the ball towards the set of targets.

29 Claims, 2 Drawing Sheets

BALL AND TARGET GAME

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

1. Field of the Invention

This invention relates to a type of amusement device in which one or more players or participants roll a tangible body such as a ball towards a target across a playing surface. Use of the device involves both skill and chance. A score is determined according to a set of rules.

2. Related Art

Many amusement devices have been developed as smaller versions of a popular game. An example of this can be seen in U.S. Pat. Nos. 5,096,192; 5,374,220; 6,039,655 and 6,213,886. These patents are all drawn to small bowling type games. U.S. Pat. No. 5,865,681 is drawn to a shuffleboard type of game. U.S. Pat. No. 6,349,939 discloses a game table having different types of game surfaces available, including bowling and shuffleboard.

Other amusement devices consist of target type games. U.S. Pat. No. 5,282,635 discloses a marker toss game in which the object is to toss a marker into a central cup for maximum points. Points are assigned according to the final resting spots of the markers. U.S. Pat. No. 6,089,570 discloses a ball and target game in which a ball is rolled towards the target. The ball and target have hook and loop components such that the ball will stick to the target at a point where the ball contacts the target. Scores are assigned depending upon location of the contact.

A feature common to all of the above amusement devices is the reliance on skill to successfully play the devices. None of the devices integrates an element of chance. Accordingly, there is a need for an amusement device which incorporates both skill and chance. The invented device fills this need.

SUMMARY OF THE INVENTION

The invention is an amusement device involving a ball, a set of targets and a set of obstructions. Specifically, the device has a target which is a plurality of concavities towards which a ball is rolled. A plurality of obstructions located near the concavities act to deflect a rolling ball. The ball is rolled towards the concavities in a number of ways. The participant can directly roll the ball towards the concavities. The participant can also roll the ball away from the concavities into an elastic member which then rebounds the ball towards the concavities. Finally, the participant can place the ball in contact with the elastic member, stretch the elastic member away from the concavities, and release the elastic member causing the ball to be propelled towards the concavities as the elastic member is returned to a relaxed state.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
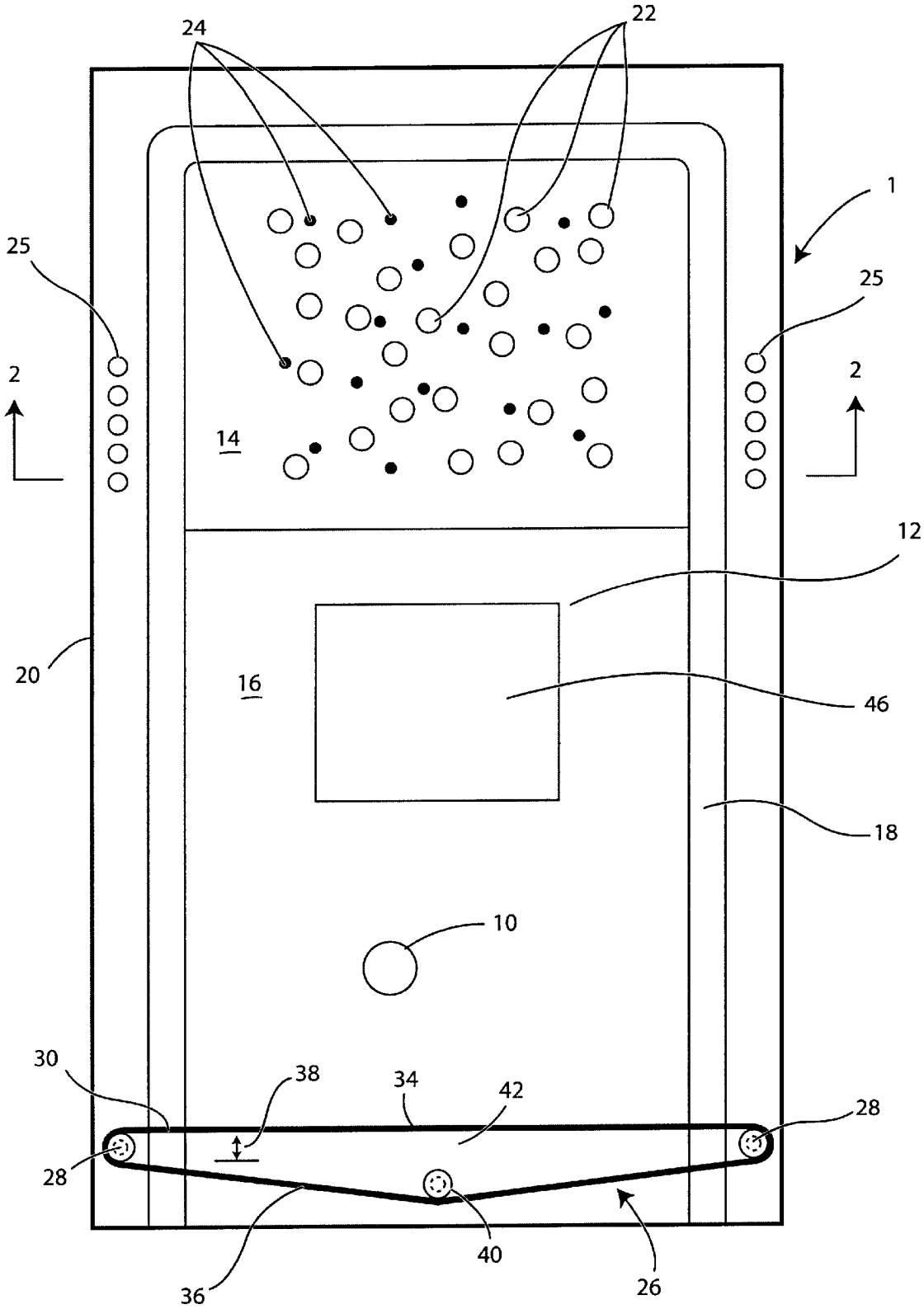
FIG. 1 illustrates a top plan view of the playing surface.
Figure 3:
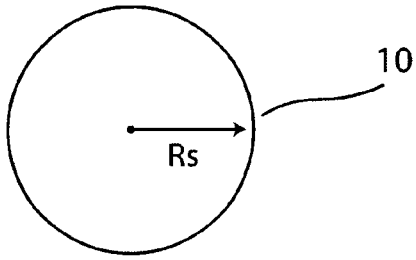
FIG. 3 illustrates a cutaway view of the sphere.

Referring to the accompanying drawings in which like reference numbers indicate like elements, FIG. 1 illustrates a top plan view of the amusement device 1. The device 1 utilizes a sphere 10 which, in the preferred embodiment, is a marble. Sphere 10 could also be metal, plastic, rubber, glass or any other suitable material. FIG. 3 shows a cutaway view of sphere 10. It can be seen that sphere 10 has a spherical radius $R_s$.

Amusement device 1 includes a play surface 12 (FIG. 1). Play surface 12 is rectangular in shape (in the preferred embodiment) and is divided into a target section 14 and a launch section 16. In the preferred embodiment, a groove 18 having a semi-circular cross section is located adjacent a periphery 20 of the play surface 12. It should be noted that the play surface 12 can be any suitable shape. It should also be noted that groove 18 could have any suitable cross section, including square.

A plurality of concavities 22 are located in the target section 14. A plurality of obstructions 24 are also located in the target section 14. In the preferred embodiment, the plurality of obstructions 24 are pegs which extend up from the play surface 12. The concavities 22 and obstructions 24 are located at spaced apart positions throughout the target section 14. In the preferred embodiment, the concavities 22 and the obstructions 24 have a non-linear distribution. For clarity of illustration, only a few of the concavities 22 and obstructions 24 are labeled in the figures. A plurality of sphere holders 25 are located outside the groove 18. In the preferred embodiment there are five sphere holders 25 on each side of play surface 12.

Opposite target section 14 of play surface 12 is launch section 16. A projection device 26 is located in launch section 16 to propel sphere 10 towards target section 14. In the preferred embodiment, the projection device 26 is made of a pair of supports 28 extending upwardly from play surface 12 and an elastic member 30 placed around the pair of supports 28. The elastic member 30 can be made of a continuous loop of a material such as rubber. When elastic member 30 is placed around supports 28, elastic member 30 is divided into a launch member 34 and a storage member 36. Launch member 34 faces target section 14 and storage member 36 is opposite launch member 34. Launch member 34 is located a distance 38 from storage member 36. An additional support 40 is offset from a point 42 which is located between the pair of supports 28. Storage member 24 can be stretched around additional support 40 causing an increase in tension in launch member 34.

Figure 2:
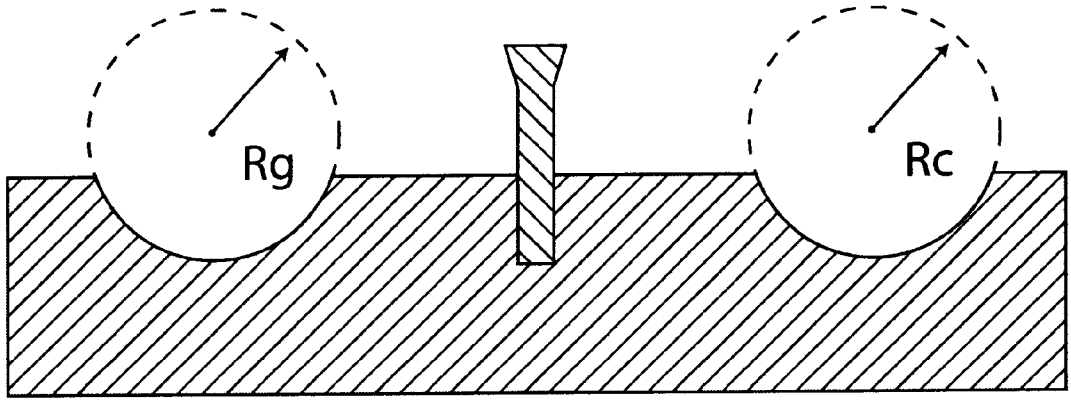
FIG. 2 illustrates a cutaway view taken along line 2—2.

Cross sections of one of the plurality of concavities 22 and the groove 18 are shown in FIG. 2. Groove 18 has a groove radius denoted $R_g$. The mathematical circle constructed by extending groove 18 into a closed curve is shown in dashed lines in FIG. 2. Likewise, concavity 22 has a concavity radius $R_c$. Spherical radius $R_s$ of sphere 10 (FIG. 3) is less than both the concavity radius $R_c$ and the groove radius $R_g$. This allows sphere 10 to come to rest in concavity 22 or groove 18. In addition, it should be noted that the distance 38 between launch member 34 and storage member 36 is less than two times the spherical radius $R_s$. This allows a plurality of spheres 10 to be stored between launch member 34 and storage member 36 when launch member 34 is not being used to launch spheres.

The plurality of concavities 22 is organized using a color coding scheme in which groups of concavities 22 are painted different colors. In the preferred embodiment, the concavities of one group are painted yellow, the concavities of another group are painted green, the concavities of another group are painted blue and the concavities of another group are painted red. Each of the colors corresponds to a score as will be discussed below. A scoring legend 46 can be depicted on the play surface 12.

In use device 1 is placed on a flat surface. Spheres 10 are removed from between storage member 36 and launch member 34. As was noted above, the distance between storage member 36 and launch member 34 is smaller than two times the spherical radius $R_s$. As a result, storage member 36 and launch member 34 effectively hold a plurality of spheres 10 between them. Preferably, storage member 36 is placed around additional support 40. This increases the tension in launch member 34.

Spheres 10 can then be placed in the sphere holders 25 to prepare for each turn of the game. A sphere 10 is removed from a sphere holder 25 and then is placed into play. This can be done in a number of ways. One way is for a player to hold sphere 10 against launch member 34 and to then pull launch member away from the target section 14. Upon release of the sphere 10 the launch member 34 will return to its relaxed state sending the sphere towards the target section 14. As the sphere arrives in the target section 14, the obstructions 24 come into play to deflect the travel of the sphere 10. The turn is over when the sphere 10 comes to rest in one of the concavities 22 or the groove 18. If the sphere 10 stops in a concavity 22 the color is noted and the color coding scheme is consulted. A score is assigned based on the result according to the rules of the game. Players can take turns rolling the sphere 10 until a winning score is accumulated.

Another mode of use is to set the device 1 up as above, but instead of shooting the sphere with the launch member 34, the sphere 10 is rolled from the direction of the target section 14 towards launch member 34 and rebounded towards the target section 14. The rest of the use of device 1 in this mode is the same as above. Finally, elastic member 30 can be entirely removed from the device 1, and then sphere 10 is manually rolled towards target section 14. (Alternatively, sphere 10 may be manually rolled toward target section 14 without removing elastic member 30.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, the projection device could also be a ramp (not shown) or a pinball type actuator (not shown) so long as the sphere 10 is propelled towards the target section. Thus, the breadth and scope of the present invention should not be limited by any of the above-described exemplary embodiments, but should be defined only in accordance with the following claims appended hereto and their equivalents.

What is claimed is:

1. An amusement device comprising:

a sphere having a spherical radius;

a substantially planar rectangular play surface divided into a target section; and a launch section;

a groove having a substantially semi-circular cross section, said groove being located adjacent a periphery of said play surface;

a plurality of concavities located in said target section;

a plurality of obstructions located in said target section; and wherein said groove has a groove radius which is larger than said spherical radius and said concavity has a concavity radius which is larger than said spherical radius.

2. The amusement device of claim 1 further comprising a projection device located in said launch section.

3. The amusement device of claim 2 wherein said projection device further comprises:

a pair of supports extending up from said play surface in said launch section; and an elastic member attached to said pair of supports.

4. The amusement device of claim 3 wherein said elastic member further comprises;

a launch member located on a target side of said supports;

a storage member located on an opposite side from said target side; and wherein a distance between said launch member and said storage member is less than two times said spherical radius.

5. The amusement device of claim 4 wherein said elastic member is a continuous loop which is stretched around said supports.

6. The amusement device of claim 5 further comprising:

an additional support offset from a point located between said pair of supports.

7. The amusement device of claim 1 wherein said concavities are color coded.

8. The amusement device of claim 7 further comprising a scoring legend corresponding to said color coded concavities.

9. The amusement device of claim 1 wherein said concavities have a non-linear distribution.

10. The amusement device of claim 1 wherein said obstructions have a non-linear distribution.

11. The amusement device of claim 1 further comprising a plurality of sphere holders located outside said groove.

12. An amusement device comprising:

a sphere having a spherical radius;

a substantially planar play surface divided into a target section; and a launch section;

a groove located around a periphery of said play surface;

a plurality of concavities located in said target section;

a plurality of obstructions located in said target section;

a pair of supports extending up from said play surface in said launch section; and an elastic member attached to said pair of supports.

13. The amusement device of claim 12 wherein said elastic member further comprises;

a launch member located on a target side of said supports;

a storage member located on an opposite side from said target side; and wherein a distance between said launch member and said storage member is less than two times said spherical radius.

14. The amusement device of claim 12 wherein said elastic member is a continuous loop which is stretched around said supports.

15. The amusement device of claim 14 further comprising:

an additional support offset from a point located between said pair of supports.

16. The amusement device of claim 12 wherein said concavities are color coded.

17. The amusement device of claim 16 further comprising a scoring legend corresponding to said color coded concavities.

18. The amusement device of claim 12 wherein said concavities have a non-linear distribution.

19. The amusement device of claim 12 wherein said obstructions have a non-linear distribution.

20. The amusement device of claim 12 further comprising a plurality of sphere holders located outside said grove.

21. An amusement device comprising:

a sphere having a spherical radius;

a substantially planar play surface and divided into a target section; and a launch section;

a groove located around the periphery of said play surface;

a plurality of concavities located in said target section;

a plurality of obstructions located in said target section;

a projection device located in said launch section, and wherein said concavities are color coded.

22. The amusement device of claim 21 wherein said projection device further comprises:

a pair of supports extending up from said play surface in said launch section; and an elastic member attached to said pair of supports.

23. The amusement device of claim 22 wherein said elastic member further comprises;

a launch member located on a target side of said supports;

a storage member located on an opposite side from said target side; and wherein a distance between said launch member and said storage member is less than two times said spherical radius.

24. The amusement device of claim 22 wherein said elastic member is a continuous loop which is stretched around said supports.

25. The amusement device of claim 24 further comprising:

an additional support offset from a point located between said pair of supports.

26. The amusement device of claim 21 wherein said concavities are color coded.

27. The amusement device of claim 26 further comprising a scoring legend corresponding to said color coded concavities.

28. The amusement device of claim 21 wherein said concavities have a non-linear distribution.

29. The amusement device of claim 21 wherein said obstructions have a non-linear distribution.

* * * * *